United States Patent [19]

Lassche

[11] 4,029,298

[45] June 14, 1977

[54] ESCAPE DEVICE

[76] Inventor: Jakob Lassche, Weerseloseweg 255, Enschede, Netherlands

[22] Filed: July 17, 1975

[21] Appl. No.: 596,719

[30] Foreign Application Priority Data

July 18, 1974 Netherlands ..... 7409766

[52] U.S. Cl. ..... 254/158; 188/270

[51] Int. Cl.[2] ..... A62B 1/12

[58] Field of Search ..... 254/151, 152, 153, 154, 254/157, 158, 159, 160; 188/270; 242/107 R

[56] References Cited

UNITED STATES PATENTS

| | | | |
|---|---|---|---|
| 197,899 | 12/1877 | Root | 188/270 |
| 326,726 | 9/1885 | Dittrick | 254/160 |
| 749,406 | 1/1904 | Spiro | 254/153 |
| 1,081,865 | 12/1913 | Rhodes | 188/270 |
| 2,811,334 | 10/1957 | Blackburn | 254/152 |
| 3,602,483 | 8/1971 | Russell et al. | 254/157 |

FOREIGN PATENTS OR APPLICATIONS

| | | | |
|---|---|---|---|
| 449,073 | 12/1948 | Italy | 254/157 |

*Primary Examiner*—Robert J. Spar
*Assistant Examiner*—Kenneth Noland
*Attorney, Agent, or Firm*—Snyder, Brown & Ramik

[57] ABSTRACT

Escape device comprising a reel having a cable wound on it, said reel being coupled with a rotatable shaft on which the outer end of a spiral spring wound on a rotatable shaft is wound with a curve opposite the curve in the rest position when the cable is winding off the reel, and said cable being coupled slip-free with a wheel carrying projecting wind blades when it is winding off the reel.

7 Claims, 13 Drawing Figures

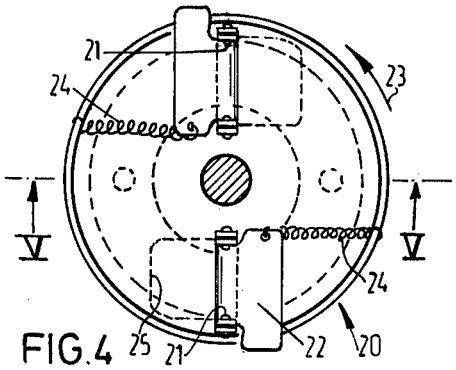
FIG.4
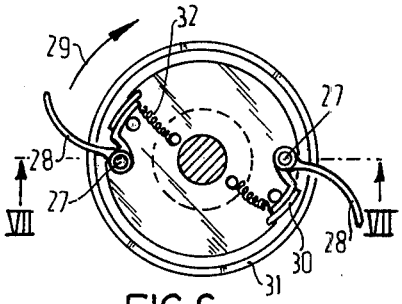
FIG.6
FIG.5
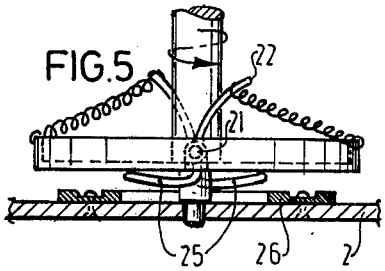
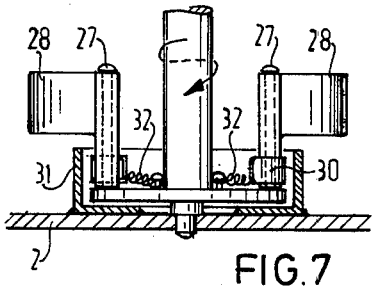
FIG.7
FIG.8
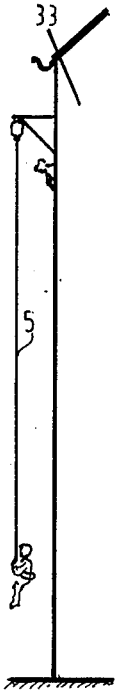
FIG.9
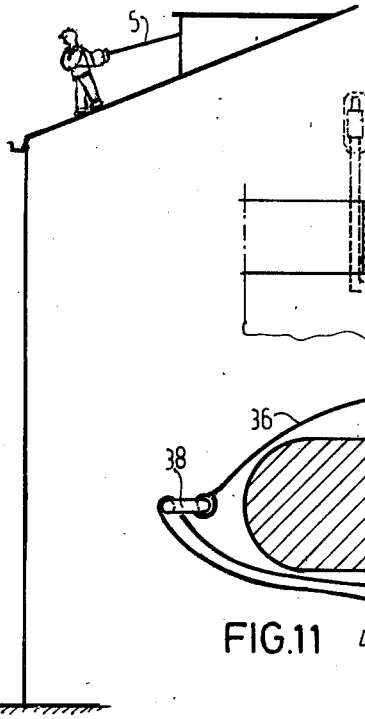
FIG.10
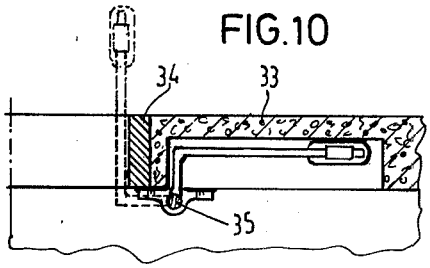
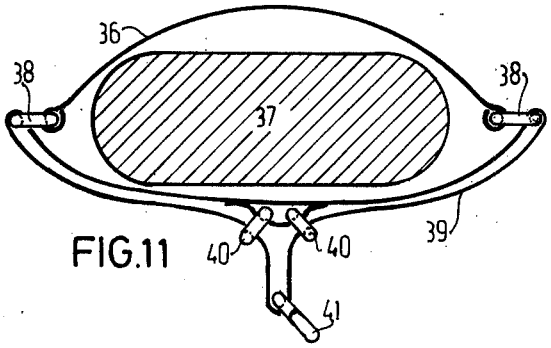
FIG.11

ESCAPE DEVICE

The invention relates to an escape device comprising a frame with fastening members, a reel rotatably journalled in said frame and having a cable wound on it, a spiral spring constantly loading the reel in the direction of winding up the cable and a brake means for reducing the speed of unwinding of the cable from the reel. Such escape devices are known in various constructions and are usually provided with a spiral spring having its inner end secured to a shaft or a drum directly coupled by a transmission with the reel with the wound cable so that the spring is stretched when the cable is wound off, whilst the brake means brakes the reel when the cable is wound off. Such a device is susceptible of improvements since the tension of the spring as well as the braking effect constantly increase according as the cable winds off further.

Conversely, when the cable is rewound on the reel the force exerted by the spring decreases and the torque to be exerted increases since the diameter on the reel increases so that the cable may not be wound up completely. There is, moreover, always some amount of clearance between the turns of the cable on the reel so that, when a tractive force is exerted on the cable the latter is first stretched around the reel before the brake become operative. The invention has for its object to avoid these drawbacks and provides an escape device of the kind set forth, differing from the prior art in that in the rest position the spiral spring is fastened by the inner end to a stationary shaft and by the outer end to a rotatable shaft, which is coupled by means of a transmission with the reel so that, when the cable winds off the reel, the spring is wound in a curve opposite the curve in the rest position on said shaft, the brake means being provided with at least one wheel carrying projecting wind blades and coupled slip-free therewith in the unwinding direction of the cable.

Since the brake means directly acts upon the unwinding end of the cable, the speed of the cable is kept constant within predeterminable limits, whilst in addition the free run of the reel at the beginning is avoided. Moreover, by using the spring structure described the force exerted by the spring on the reel is kept constant. Finally, by using a wind-bladed wheel the generated wind has a braking effect without producing substantially any heat. This wind produced may, moreover, be used for actuating an additional brake means, which becomes operative as soon as a given wind pressure is attained. The bladed wheel may conveniently accomodated in a housing having a air inlet and an air outlet, at least one of which comprises at least one flap movable against spring force.

The flap(s) may open the air inlet of the housing at an increasing air speed and close the same at a decreasing air speed in the inlet. As a further alternative two wheels with wind blades may be employed, the blades of which are movable closely one along the other and in opposite senses so that the produced air flow is pushed from one blade wheel towards the other blade wheel.

Finally, at least one flap may be arranged in the air outlet, said flap closing the outlet against spring force at an increasing air speed in the outlet and said flap being coupled with a brake acting by friction on a component part rotating during unwinding of the cable.

With a given rotary speed of the blade wheel the wind pressure produced will overcome the force exerted by the spring on the flap and the brake will become operative until the spring force overcomes the wind pressure due to the decrease in rotary speed of the blade wheel. The blade wheel of the brake means may alternately be a wheel having fastened blades to it which are adapted to turn about substantially radial axes, said blades being inwardly spring-loaded, that is to say, towards the wheel and having each a brake shoe projecting beyond the shaft and being urged against a brake plate rigidly secured in the frame during a movement against the spring force. Alternately, the wheel may be provided with blades adapted to rotate about axes extending parallel to the wheel axis and connected with brake shoes adapted to be pushed against spring force against a brake drum rigidly secured in the frame. In a modified embodiment the brake means may be provided with a dynamo and a brake means acting upon the reel and controlled in accordance with the curred supplied by the dynamo.

The invention will be described with reference to the accompanying drawing, which shows a few embodiments which are to be preferred.

FIG. 4 is an elevational view of a decelerating member.

FIG. 5 is a sectional view taken on the line V—V of the decelerating member of FIG. 4.

FIG. 6 shows a further embodiment of a decelerating member.

FIG. 7 is a sectional view taken on the line VII—VII in FIG. 6 of the decelerating member of FIG. 6.

FIG. 8 is a schematic plan view of the arrangement of an escape device in a building.

FIGS. 9 and 10 illustrate schematically possibilities of use of the escape device.

FIG. 11 shows a self-stropping belt.

Figure 1:
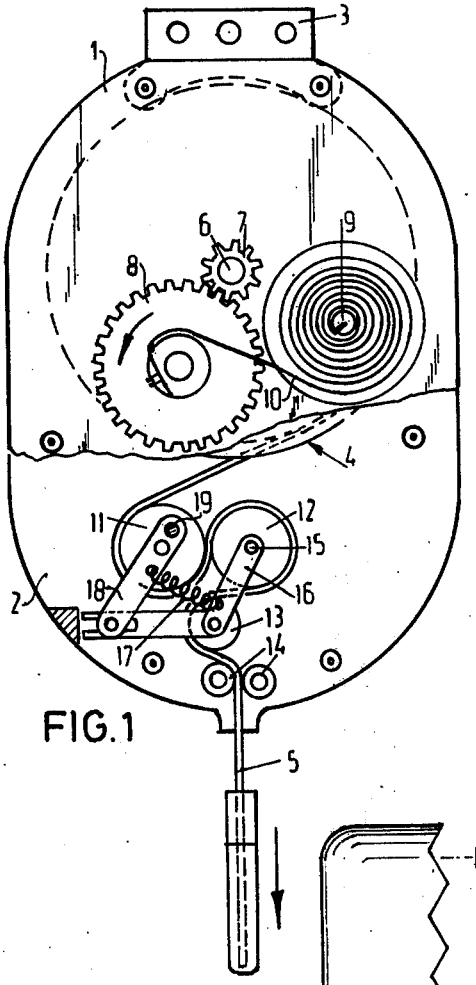
FIG. 1 shows an escape device, the protective hood of which is removed and parts being broken away, in a front view.
Figure 2:
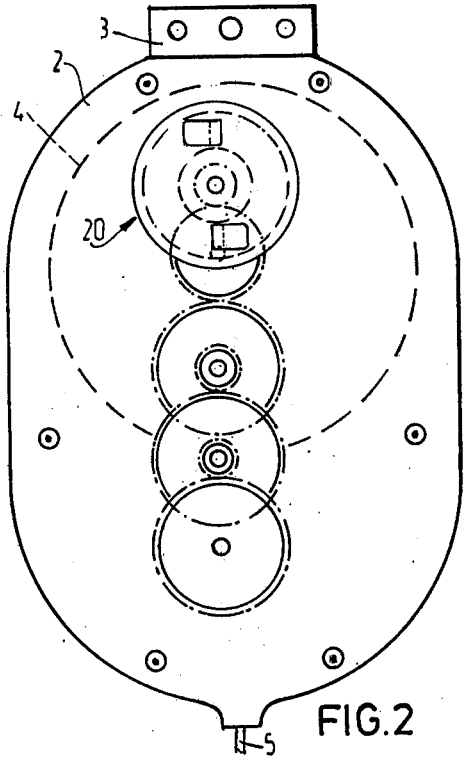
FIG. 2 is a rear view of said device, the other protective hood of which is removed.
Figure 3:
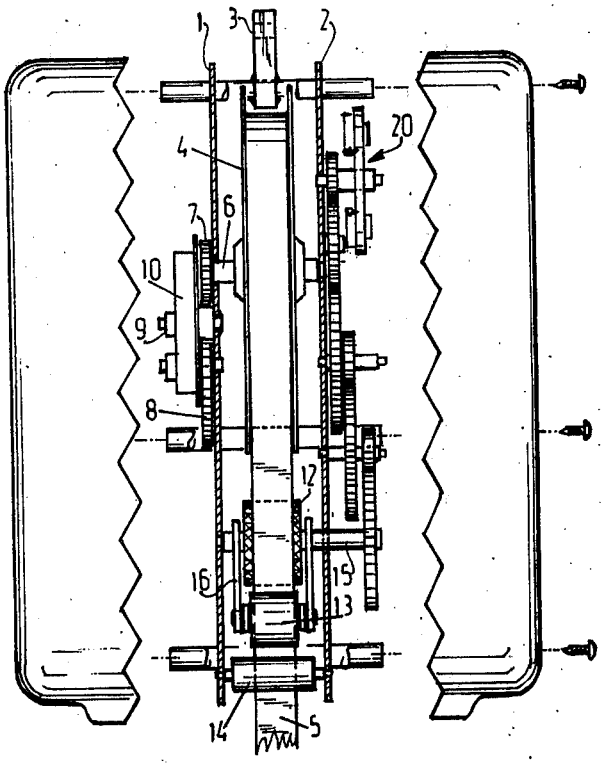
FIG. 3 is a side elevational view of the escape device, the protective hoods being removed.

FIGS. 1, 2 and 3 show the escape device according to the invention, viewed from different sides. A front plate 1 and a rear plate 2 are connected with one another and provided with suspension members 3. Between these plates a drum 4 is rotatably arranged and has wound on it a long belt 5. Together with the shaft 6 and a gear wheel 7 the drum 4 is rotatably journalled in the plates. The gear wheel 7 is in mesh with a gear wheel 8 of larger diameter, connected with a roller, to which is secured one end of a spiral spring 10 wound on a rotatable stock reel 9. When the belt 5 runs off the drum 4, the spiral spring is wound in opposite sense on the roller connected with the gear wheel 8 so that, when tractive force on the belt 5 is absent the drum is driven in the reverse direction and the belt is rewound.

After the belt 5 has left the drum 4 is runs around a pressing roller 11, a dosing roller 12 and a tightening roller 13 and finally downwards in between guide rollers 14. The dosing roller 12 is arranged on the shaft 15 by means of a free-wheel coupling, said shaft passing through the two plates 1 and 2 and being connected at this place with decelerating members. About this shaft 15 are adapted to oscillate two swinging rods 16, where the stretching roller 13 is rotatably arranged. When a tractive force is exerted on the belt 5, the stretching roller of FIG. 1 is moved to the right and thus stretches a draw spring 17, the other end of which is connected with a lever 18. The lever 18 is afforded by a pin 19 arranged on the plate 2, whereas the pressing roller is adapted to rotate about a shaft fastened to the rod and located between the point of application of the spring 17 and the pin 19. When the tractive force on the belt 5 increases, the pressing roller will urge the belt with heavier force against the rough dosing roller 12 so that no slip can occur.

The shaft 15 passing through the two plates 1 and 2 is connected through a series of gear wheels accelerating the movement with a decelerating member 20 in the form of a wheel, which is, therefore, rotated very rapidly when the belt is running off. FIGS. 4 to 7 show two embodiments of such a wheel, although as a matter of course, this wheel may be a dynamo coupled with a brake means acting upon the roller 12, which is controlled in dependence upon the current generated by said dynamo.

The wheel shown in FIGS. 4 and 5 is provided with blades 22, adapted to rotate about substantially radial axes 21 and passing through an opening in the wheel and being bent over on the other side thereof. The direction of movement of the wheel 20, when the belt 5 is unwinding, is indicated by the arrow 23. The winding produced by the rotation pushes the blades rearwards, but this movement is counteracted by the draw springs 24. When a given number of revolutions is exceeded, the wind pressure will overcome the force of the springs so that the blades will turn rearwardly, the bent-over tags 25 on the other side of the wheel thus being urged against a brake lining 26 on the plate 2, as a result of which the speed of the wheel decreases.

FIGS. 6 and 7 shows a modified embodiment of the decelerating wheel 20, which carries in this case pins 27 extending parallel to the wheel axis, about which pins outwardly projecting blades 28 are adapted to rotate. When the wheel is rotating in the direction of the arrow 29, the blades lag behind owing to the wind produced by the rotation and the brake blocks 30 projecting from the front side are urged against the inner side of a brake drum 31 secured to the plate 2. The brake blocks thus move against the action of draw springs 32.

The emergency device may be very conveniently fastened to a frame which is fastened, in the rest position shown in FIG. 8, to the inner side of a wall 33 at the side of a window frame 34. This frame is adapted to rotate about a vertical shaft 35 and, when the window is opened, it can be swung through the window opening to the outside, after which the escape device is ready for use.

FIG. 9 illustrates how a person can reach safety by lowering himself by the single belt 5, whilst the escape device is attached to the frame inside the building. Conversely a person wanting to leave a building and having to go via a dormer window on the roof and along the eaves can fasten the escape device to the ring and the end of the belt in the building. This situation is illustrated in FIG. 10.

A suitable belt for use with the escape device shown in FIG. 11 is illustrated schematically. This belt is provided with a broad strap 36 stiffened by ribs in a curved state, the height of which is slightly smaller than half the circumference of an average human trunk 37, at both ends it is provided with an eyelet 38. Through these eyelets 38 is passed an endless belt 39, the parts emerging from the eyelets on the outside passing each through an eyelet 40. These eyelets are fastened near one another to the run of the belt 39 located on the inner side. The part of the belt 39 lying between the eyelets 40 is provided with a fastening member, for example, a carbine hook 41.

Figure 12:
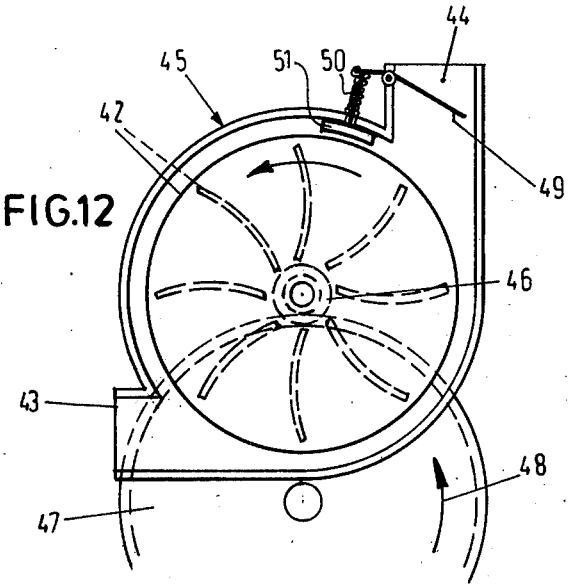
FIG. 12 is an elevational view of a brake means in a different embodiment.

FIG. 12 shows a wheel 42 provided with fixed blades and adapted to rotate in a housing surrounding said wheel and provided with an air inlet 43 and an air outlet 44. The wheel is provided with a pinion 46, which is engaged by a large gear wheel 47 coupled with the roller 12, along which the belt 5 passes.

When the gear wheel 47 rotates in the direction of the arrow 48, when the belt is unwinding, the blades push air against a flap 49, rotatably arranged in the air outlet and closing the outlet as soon as the force of a spring 50 is overcome. By its movement the flap 49 urges a brake block 51 pivotally connected herewith against the wheel 42 so that the wheel is braked, the pressure exerted on the flap 49 decreases and the brake block 51 is lifted from the wheel by the spring 50.

Figure 13:
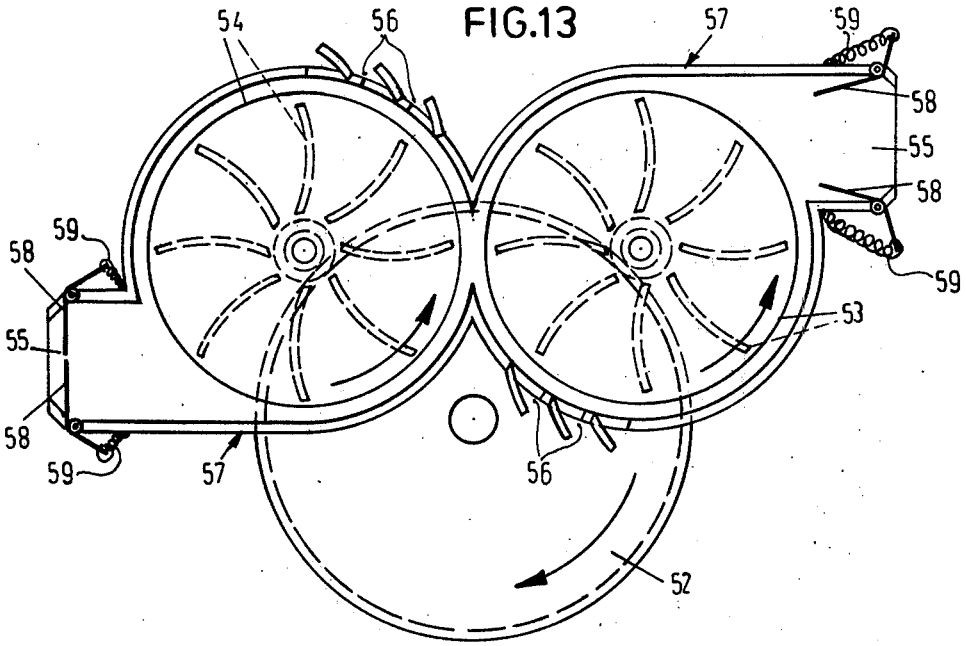
FIG. 13 is an elevational view of a further embodiment of a brake means comprising two relatively counteracting blade wheels.

FIG. 13 shows a brake means comprising two blade wheels 53, 54 driven by the same gear wheel 52 and arranged in the same housings, the blades moving closely along one another in opposite senses in the housing. The wind produced by one blade wheel thus has a braking effect on the other and conversely. The air sucked in by the blade wheels can enter the housing 57 through inlet apertures 55 and can leave the same through slatted-blind-like outlet apertures 56, which may, if desired, be shut by spring-loaded flaps.

The air inlets comprise flaps 58, which are normally held by springs 59 in a position shutting the major part of the inlet apertures, whereas against the force of said springs they can move inwardly. As soon as the rotary speed of the blade wheels has increased to an extent such that the suction force produced overcomes the force of the springs 59, the flaps 58 will move inwardly and open the air inlets 55 further so that the blade wheels 53, 54 are more strongly braked.

What we claim is:

1. An escape device comprising a frame with fastening members, a reel rotatably journalled in said frame and having a cable wound on it, said cable having a free end adapted to be connected to a load, a spiral spring constantly loading the reel in the cable winding-up sense and a brake means for limiting the speed by which the cable winds off the reel, characterized in that in the rest state the spiral spring is fastened by the inner end to a rotatable shaft and by the outer end to a rotatable shaft, which is coupled by a transmission with the reel so that, when the cable is winding off the reel, the spring is wound on said shaft with a curve opposite the curve in the rest position and in that the brake means comprises an element engaging said cable between said reel and the free end of the cable and at least one wheel carrying projecting wind blades which wheel is uncoupled from said element when the cable is in its winding direction but is coupled to said element when the cable is unwinding so as to brake said element, said wheel carrying blades are accommodated in a housing provided with an air inlet and an air outlet in at least one of which is arranged at least one flap movable against spring force.

2. An escape device as claimed in claim 1, characterized in that the flap opens the air inlet at an increasing speed of the air flow in the inlet and closes the same at a decrease in the speed of the air flow.

3. An escape device as claimed in claim 1, characterized by two wheels having wind blades, said blades being movable closely along another and in opposite senses in this area.

4. An escape device as claimed in claim 1, characterized in that the flap closes the air inlet against spring force at an increase in speed of the air stream through said inlet and is coupled with a brake acting by friction on a component part rotating when the cable is unwinding.

5. An escape device as claimed in claim 1, characterized in that the brake means comprises a wheel to which are fastened blades adapted to turn about substantially radial axes and inwardly spring-loaded and carrying each a brake shoe projecting beyond the axis and being pushed, when moving against the spring force, against a brake plate rigidly secured in the frame.

6. An escape device as claimed in claim 1, characterized in that the brake means comprises a wheel carrying blades adapted to rotate about axes extending parallel to the axis of the wheel and being connected with brake shoes adapted to be urged against spring force against a brake drum rigidly secured in the frame.

7. An escape device as claimed in claim 1, characterized in that the brake means comprises a dynamo and a braking member acting on the roller and controlled in dependence upon the current generated by the dynamo.

* * * * *